United States Patent [19]

Gordon

[11] 4,314,116

[45] Feb. 2, 1982

[54] KEYBOARD SWITCH WITH GRAPHIC OVERLAY

[75] Inventor: Herman B. Gordon, Tempe, Ariz.

[73] Assignee: Rogers Corporation, Rogers, Conn.

[21] Appl. No.: 161,776

[22] Filed: Jun. 23, 1980

[51] Int. Cl.[3] ..... H01H 13/70

[52] U.S. Cl. ..... 200/5 A; 200/159 B; 200/308

[58] Field of Search ..... 200/1 R, 5 R, 5 A, 159 B, 200/86 R, 302, 308, 309, 317

[56] References Cited

U.S. PATENT DOCUMENTS

| | | | |
|---|---|---|---|
| 3,591,749 | 7/1971 | Comstock | 200/5 A X |
| 3,860,771 | 1/1975 | Lynn et al. | 200/5 R X |
| 4,046,975 | 9/1977 | Seeger, Jr. | 200/159 B X |
| 4,059,737 | 11/1977 | Gergaud | 200/5 A |
| 4,060,703 | 11/1977 | Everett, Jr. | 200/5 A |
| 4,066,850 | 1/1978 | Heys, Jr. | 200/159 B X |
| 4,127,752 | 11/1978 | Lowthorp | 200/5 A |
| 4,128,744 | 12/1978 | Seeger | 200/159 B |
| 4,237,351 | 12/1980 | Boulanger et al. | 200/5 A |

OTHER PUBLICATIONS

G. G. Promis et al., IBM Tech. Disc. Bull., "Control Panel," vol. 19, No. 2, Jul. 1976, pp. 405, 406.

D. O. Johnson, Jr., IBM Tech. Disc. Bull., "Keyboard with Changeable Encoding and Key Designation," vol. 13, No. 7, Dec. 1970, pp. 2041, 2042.

*Primary Examiner*—James R. Scott

*Attorney, Agent, or Firm*—Fishman and Van Kirk

[57] ABSTRACT

A keyboard has first and second nested planar members with depressions formed thereon. The upper member is transparent. The lower member may be color coded and carry replaceable key indicia in the depressions.

The laminated overlay nested planar members are disposed adjacent to a conventional elastomeric diaphragm switch assembly having an upper layer of shaped protrusions abutting the lower most inner surfaces of the second or lower member depressions. Frame structure of variable form assists in retaining the laminated overlay members in fixed relationship to the elastomeric diaphragm switch assembly.

8 Claims, 3 Drawing Figures

KEYBOARD SWITCH WITH GRAPHIC OVERLAY

BACKGROUND OF THE INVENTION (1) Field of the Invention

This invention relates to keyboard devices. More particularly, this invention relates to apparatus for identifying key stations and for changing key station identification.

(2) Description of the Prior Art

A conventional membrane or diaphragm keyboard includes an array of keys which may be individually actuated to close a pair of contacts of an electrical circuit associated with each of the keys. It is often considered desirable to provide for tactile feedback so that, when the keys are pressed by the finger of a person operating the keyboard, the keys "snap" and force discontinuity is transmitted to the finger of the user indicating that the key has been actuated and thus an electrical signal has been generated in the circuit associated with the key. A conventional prior art keyboard may include a flat flexible legend sheet which defines a plurality of points or areas on the sheet which the operator of a keyboard may press to actuate a snap-action element associated with the particular point or area. Typically, the points or areas on the legend sheet are indicated in some visual manner, that is, the legend sheet may have printed thereon a legend indicating the function of the key positioned beneath the legend sheet. For example, the legend sheet may include a series of numbers, letters or symbols such as those on a typewriter, or calculator or data terminal keyboard, or, the legend may indicate the particular item to be purchased at a retail outlet.

One problem with prior art keyboards having flat legend sheets is that the area or point to be actuated on the legend sheet must be visually located. Once the particular point or area on the keyboard is visually located, the person using the keyboard must position his finger or some other object directly in contact with the point or area and press downwardly to actuate a particular key. The accuracy of the data entered by means of the keyboard, accordingly, is a function of operator attentiveness. If the keys are pressed at points removed from the center of the key, the electrical circuit contacts operated by the key may be closed without providing tactile feedback or the key may provide tactile feedback without contact being made.

Copending application Ser. No. 100,861 filed Dec. 6, 1979 (assigned to the assignee hereof) disclosed keyboard structure having depressions at key locations. However, that prior application did not disclose any simple way for varying or changing key indicia.

Accordingly, it is an object of this invention to provide keyboard apparatus wherein changing or varying key indicia can be easily effected for some keys, while other keys may be permanently labeled if desired.

It is an object of the present invention to provide a keyboard wherein the keys may be located by an operator in a non-visual manner, that is, the keys may be perceived by touch in addition to being perceived visually.

SUMMARY OF THE INVENTION

In accordance with the preferred embodiment of the invention the keyboard includes a snap-action element of the type which provides tactile feedback when operated. The invention further includes a continuous flexible legend sheet which has a plurality of depressions or concavities which are perceptible both by touch and sight and serve as key locators. The continuous flexible legend sheet provides the benefits of moisture and dust exclusion found with prior art flat legend sheets and also provides the advantage of being perceptible by touch. Printed tags with numbers or other indicia thereon are located in the base of some or all of the depressions and are removably adhered to the base of the depression. A transparent overlay with mating depressions covers and nests with the legend sheet. The legend sheet may also carry some permanently printed indicia and may also serve as a cosmetic element; that is, graphics or multicolor displays may be printed on the legend sheet to provide an aesthetically pleasing legend sheet.

BRIEF DESCRIPTION OF THE DRAWINGS

The present invention may be better understood and its numerous objects and advantages will be apparent to those skilled in the art by reference to the accompanying drawings wherein like reference numerals refer to like elements in the several FIGURES and in which.

DETAILED DESCRIPTION OF THE INVENTION

Figure 1:
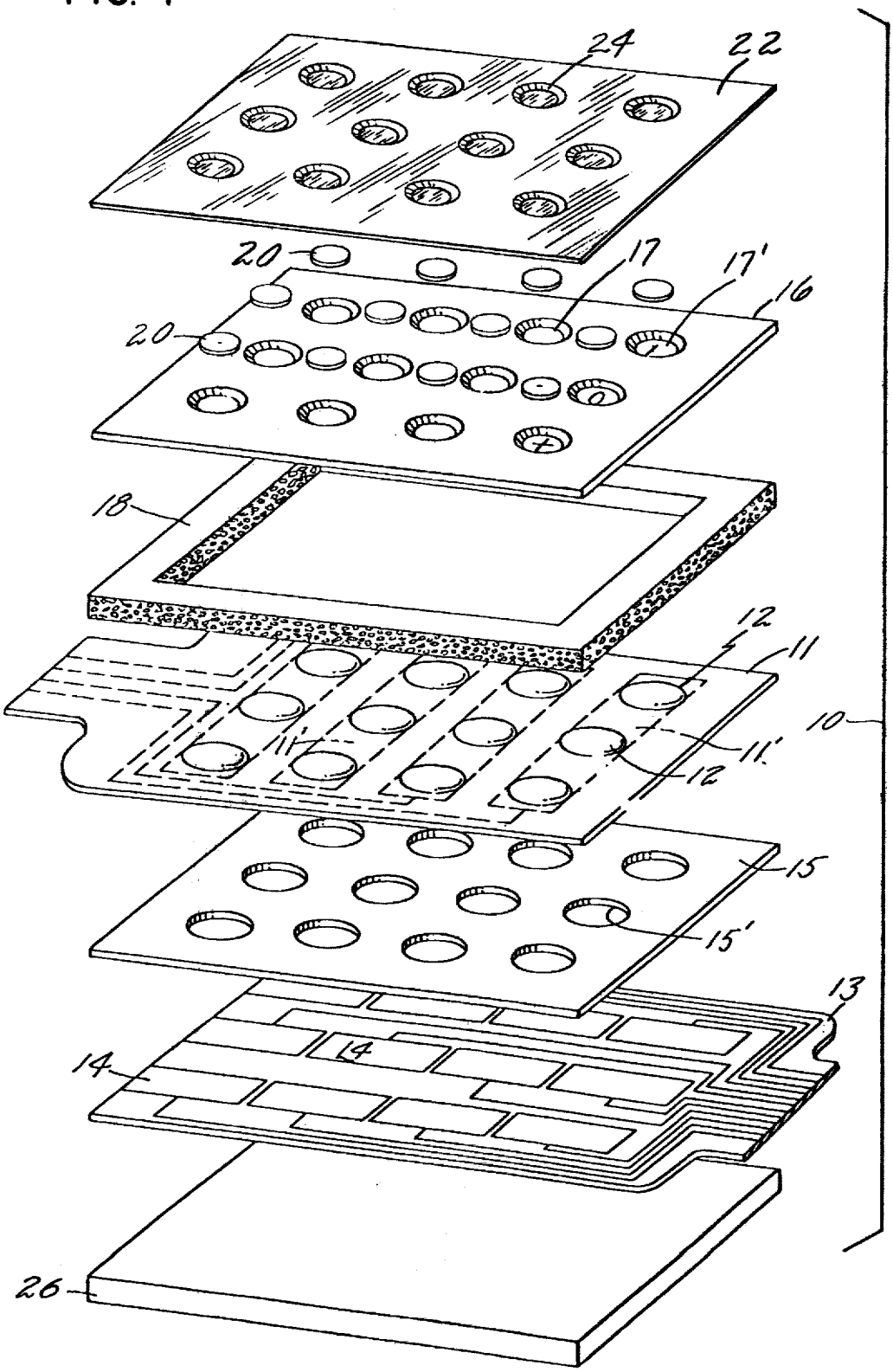
FIG. 1 is an exploded view of the components of the keyboard shown in FIG. 1.
Figure 2:
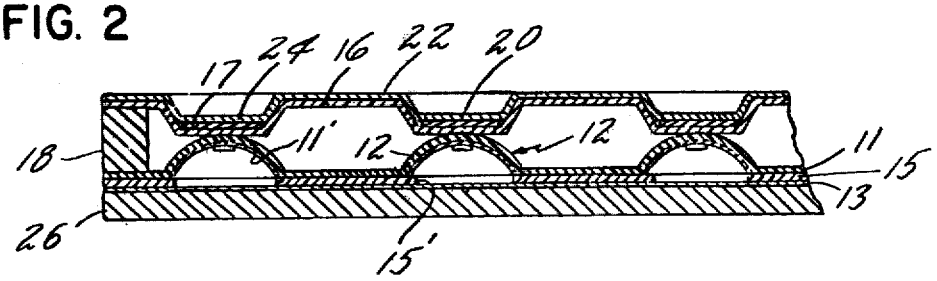
FIG. 2 shows a cross-sectional view of the keyboard of FIG. 1.

Referring to FIGS. 1 and 2 simultaneously, a keyboard indicated generally at 10 includes a first thin (0.003 to 0.020) flexible circuit sheet 11 including a plurality of integral domed protrusions 12 formed therein. Sheet 11 is a plastic material, such as the Polyethylene Terpthalate known as Mylar. The domed protrusions 12 function as snap-action tactile elements. Conductive paths, such as copper, conductive ink or other conductive materials, are formed on and are bonded to the underside of sheet 11 by conventional printed circuit techniques and extend into and follow at least part of the contour of each protrusion 12. Thus, in FIG. 1, a plurality of parallel "row" conductors 11' extend into protrusions 12 and may cover all or part of the under surface thereof. The keyboard 10 further includes a second (0.003–0.020") flexible circuit sheet 13 of Mylar or other plastic which carries printed circuitry in the form of parallel "column" conductors 14 on the top thereof. The first flexible plastic sheet 11 is spaced from the second plastic flexible sheet 13 by a third thin (0.005–0.010") sheet 15 of plastic (e.g. Mylar) or other non-conductive separator material. Sheet 15 is provided with a plurality of die-cut apertures 15'. Sheet 15 may be adhesively bonded to sheets 11 and 13. Each snap-action tactile element 12 is formed of a generally hemispherical invertible dome or any other snap-acting configuration known in the art.

The conductive paths 11' on sheet 11 may cover all or a portion of the surface of element 12 which face sheet 13. When a dome 12 is actuated it moves through an aperture 15' in sheet 15 and electrical contact is thus established between an individual "row" conductor 11' on sheet 11 and a "column" conductor 14 on sheet 13. Conductors 14 are shown in parallel columns only for purposes of illustration; however, as will be understood by those skilled in the art, the columns 14 on sheet 13 may be arranged in any desired circuit pattern depending on the function to be performed.

Keyboard 10 further includes a flexible legend sheet 16 having a plurality of concave depressions 17 therein. Depressions 17 are integral with sheet 16 and allow the user of keyboard 10 to perceive the location of associated keys by sight and/or touch. Depressions 17 are thus aligned with tactile snap-action elements 12, and each depression 17 is in physical contact with the top of a snap-action element 12.

Identifying tags 20 are positioned at the base of each depression 17, and the tags may be releasably bonded to the base of each depression, or they may be retained in place by a mating overlay sheet 22. The tags 20 may be paper, cardboard, plastic or other suitable material, and they bear indicia, such as numbers or other keyboard symbols for use with the particular keys of any particular keyboard, depending on the circuits, functions and encoding of the keyboard. Some of the protrusions, such as 17', may have indicia printed therein at the base for keys that are common for different keyboard designs, while the tags 20 may be printed up for use with other key locations depending on the design of the particular keyboard. In addition, the sheet 16 may be multicolored or color coded for aesthetic or functional purposes.

The keyboard also has a transparent overlay sheet 22 which has depressions 24 corresponding to and mating with the depressions 17. Overlay sheet 22 sits on top of legend sheet 16 so that the tags 20 are trapped and fixed between mating depressions 24 and 17. Since sheet 22 is transparent, the indicia on tags 20 will show through overlay sheet 22.

When a key is urged downwardly, e.g. by force from a finger or other actuator inserted in a depression 24, the dome 12 aligned with the depression inverts causing a circuit to be completed between circuitry on sheets 11 and 13 whereby an information bearing electrical signal is generated.

Legend sheet 16 is spaced from sheet 11 by a peripheral sheet of resilient cellular foam material 18. Sheet 18 is preferably made from a urethane foam material of the type having a low compression set. By low compression set, it is meant that after repeated compression and expansion, the material essentially maintains its dimensions. An example of such material is PORON foam obtainable from Rogers Corporation, the assignee of this invention. The edges of legend sheet 16 and circuit sheet 11 may be adhered to opposite surfaces of foam sheet 18 by a conventional adhesive. Transparent overlay sheet 22 may be releasably bonded to sheet 16, or sheet 22 may be otherwise secured relative to sheet 16, such as by heat stakes or other fastening means (not shown). Once keyboard 10 is formed, the keyboard is placed on a base 26. Base 26 may, for example, represent a surface of a cash register with which the keyboard may be used or base 26 may be an integral part of the keyboard 10 and may be sold with the keyboard.

Figure 3:
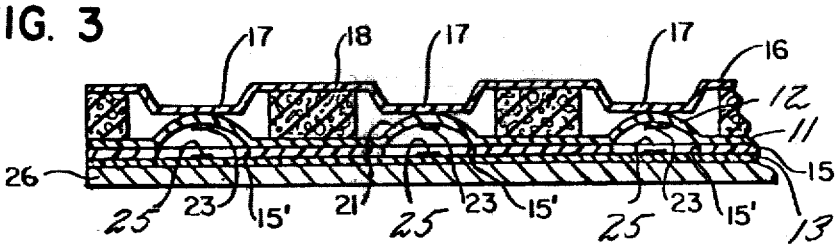
FIG. 3 shows a cross-sectional view of a keyboard in accordance with another embodiment of the present invention.

Referring to FIG. 3, another embodiment of the present invention is shown. The legend sheet 16 including a plurality of depressions 17, is on top of dome shaped snap-action elements 12. Dome elements 12 are integral with sheet 11 and include printed circuitry 23 on one surface thereof. When dome elements 12 are inverted, printed circuitry 23 contacts printed circuitry 25 on a second sheet 13. A spacer sheet 15 of insulating material isolates printed circuitry 23 from printed circuitry 25 except in the region of apertures 15'. Sheet 15 is as was previously described with respect to FIGS. 1 and 2. Legend sheet 16 is maintained in position with respect to sheet 11 by an apertured sheet of resilient foam material 18 of the type previously described. Overlay sheet 22 is on top of legend sheet 16, with tags 20 trapped between the mating depressions 17 and 24. In order to actuate a key, one of the depressions 24 is urged downwardly and dome 12 is inverted with a snap-action to thereby connect printed circuits 23 and 25. During inversion of dome 12, foam parts 18 deform but provide sufficient rigidity to allow actuation of one key without the adjacent keys being actuated.

The principal features of the present invention is a keyboard having the transparent overlay sheet 22 and the identifying tags 20 trapped between the depressions 24 of the transparent overlay sheet and the depressions 17 of the legend sheet. With these features, it is unnecessary to custom print indicia on each legend sheet. Further, a multipurpose legend sheet (without indicia or with only a few common indicia) can be produced. Then, the tags 20 are positioned in place as described above for any particular keyboard. In this way, a single legend sheet design may be used for several keyboards having different indicia requirements. Also, a keyboard can even be retrofitted with new tags 20 to change indicia if desired.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. In a switch having:

first contact means, said first contact means including a first conductive element being movable between first and second positions;

second contact means, said second contact means including a second conductive element aligned with and out of contact with said first conductive element when said first conductive element is in the first position, and said first conductive element being in contact with said second conductive element when said first conductive element is in the second position; and flexible cover sheet means, said cover sheet means defining a planar surface having at least a first depression in alignment with and extending toward said contact means conductive elements and having a base portion, whereby flexing of the base portion of said depression toward said contact means will move at least one of said conductive elements toward the other and establish electrical contact between said first and second contact means conductive elements;

the improvement comprising:

indicia bearing means for identifying a contact in said depression and supported by said base portion; and transparent overlay means over said cover sheet means, said transparent overlay means having at least a first depression mating and nesting with said first depression in said cover sheet means.

2. A switch as in claim 1 wherein:

said indicia bearing means is removably adhered to said base portion.

3. A switch as in claim 1 wherein:

said first contact means includes a sheet of plastic material having at least one snap-action protrusion formed therein;

said first conductive element is adhered to the interior of said protrusion;

said base of said cover sheet depression is in physical contact with at least a part of said protrusions; and said transparent overlay means is a sheet of plastic material.

4. In a keyboard having:

an array of snap-action electrical circuit elements, said elements being movable between a first position and a second position to provide tactile feedback;

electrical circuit contact means associated with each snap-action element;

each of said snap-action elements being out of contact with said contact means when said element is in said first position and in contact with said associated contact means when said element is in said second position; and flexible cover sheet means including a plurality of depressions, said depressions being integral with the flexible sheet means, said depressions being in alignment with said snap-action elements and movable toward said snap-action elements to move the elements between said first and second position to provide for electrical contact between said elements and said contact means and to provide tactile feedback;

the improvement comprising:

indicia bearing means for identifying contacts in at least some of said depressions in said cover sheet means; and transparent overlay means over said cover sheet means, said transparent overlay means having a plurality of depressions mating and nesting with said depressions in said cover sheet means.

5. A keyboard device as in claim 4 wherein:

said indicia bearing means are removably adhered to said depressions in said cover sheet means.

6. A keyboard device as in claim 5 wherein:

at least one of said depressions in said cover sheet means has indicia permanently affixed thereto.

7. A keyboard as in claim 4 wherein:

said array of snap-acting elements comprises a first sheet of flexible plastic material with a plurality of snappable protrusions therein and having conductive circuit elements extending into the protrusions;

said contact means comprises a second sheet of plastic material having conductive elements thereon;

each of said depressions in said cover sheet means has a base portion in physical contact with a portion of an aligned protrusion; and each of said depressions in said transparent overlay means has a base portion nesting with the base portion of mating depressions in said cover sheet means.

8. In a keyboard device having:

an array of electrical circuit switch elements, said switch elements being movable between a first position and a second position;

electrical circuit contact means associated with each switch element;

each of said switch elements being out of contact with said contact means when said element is in said first position and in contact with said associated contact means when said element is in said second position; and flexible cover sheet means including a plurality of depressions, said depressions being integral with the flexible sheet means, said depressions being in alignment with said switch elements and movable toward said switch elements to move the elements between said first and second position to provide for electrical contact between said elements and said contact means;

the improvement comprising:

indicia bearing means for identifying contacts in at least some of said depressions in said cover sheet means; and transparent overlay means over said cover sheet means, said transparent overlay means having a plurality of depressions mating and nesting with said depressions in said cover sheet means.

* * * * *